United States Patent [19]

Rogers

[11] 4,171,080

[45] Oct. 16, 1979

[54] STEEL METAL WEB HANDLING METHOD

[76] Inventor: John W. Rogers, c/o 25550 Chagrin Blvd., Cleveland, Ohio 44122

[21] Appl. No.: 878,206

[22] Filed: Feb. 16, 1978

Related U.S. Application Data

[60] Continuation of Ser. No. 818,794, Jul. 25, 1977, abandoned, which is a division of Ser. No. 713,599, Aug. 12, 1976, which is a continuation-in-part of Ser. No. 648,533, Jan. 12, 1976, abandoned, which is a continuation-in-part of Ser. No. 612,275, Sep. 11, 1975, abandoned.

[51] Int. Cl.[2] ..... B26F 3/00

[52] U.S. Cl. ..... 225/2; 225/96.5; 225/103

[58] Field of Search ..... 225/1, 2, 103, 102, 225/96.5; 242/56.1, 56.4; 214/DIG. 3, DIG. 4

[56] References Cited

U.S. PATENT DOCUMENTS

| | | | |
|---|---|---|---|
| 870,024 | 11/1907 | Edison | 242/56.4 |
| 2,742,965 | 4/1956 | Drummond, Jr. | 225/103 |
| 2,998,134 | 8/1961 | Gray | 225/4 X |
| 3,559,858 | 2/1971 | Osteen | 225/93 X |
| 3,904,097 | 9/1975 | Grambo, Jr. et al. | 225/103 |

*Primary Examiner*—Frank T. Yost
*Attorney, Agent, or Firm*—John F. Carney

[57] ABSTRACT

A method for handling an elongated web of sheet metal formed as a parent coil construct pre-divided into a plurality of severable daughter coils in which the daughter coils are selectively severed from the parent coil at one site and then transported to another ultimate point of use. The daughter coils defining the outermost ends of the parent coil form edge trim strips that protect the construct during tranport and are severed therefrom prior to or incident with ultimate use.

9 Claims, 27 Drawing Figures

10
12
14
16
18
20
22
24
26
28
30
31
32
33
34
35
36
2
4

Fig. 4
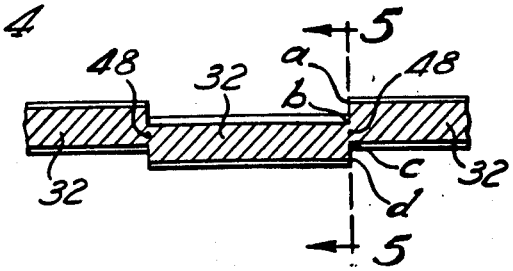
Fig. 5
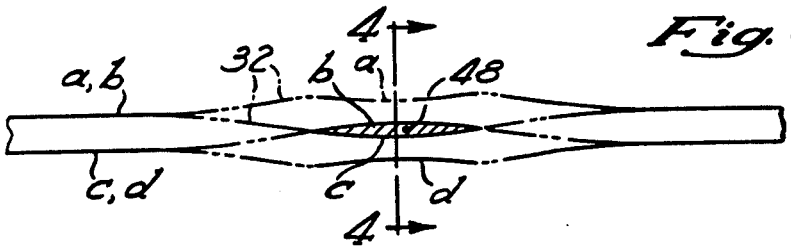
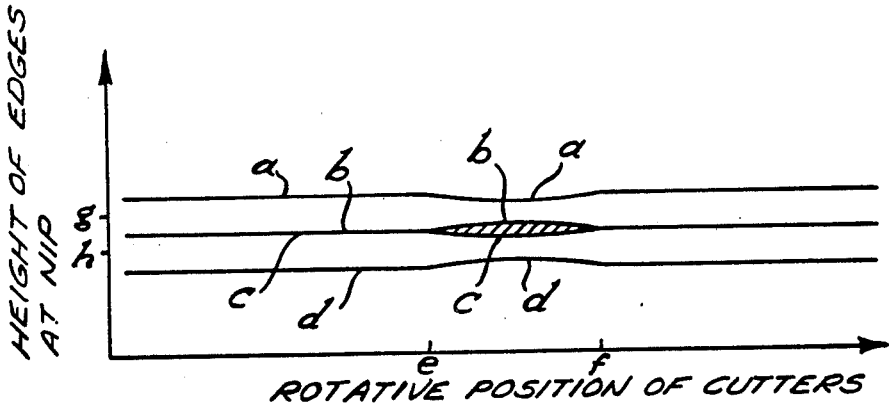
Fig. 6
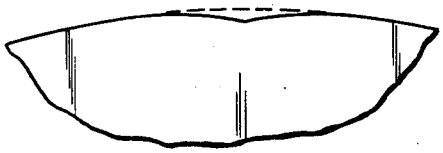
Fig. 7a
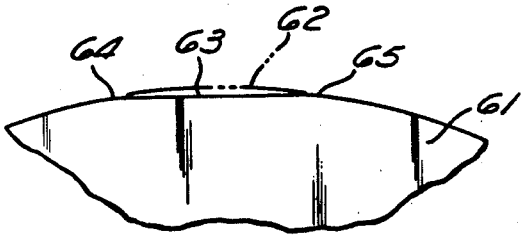
Fig. 7

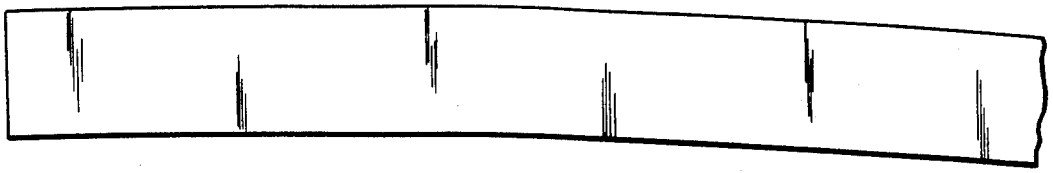
Fig. 17
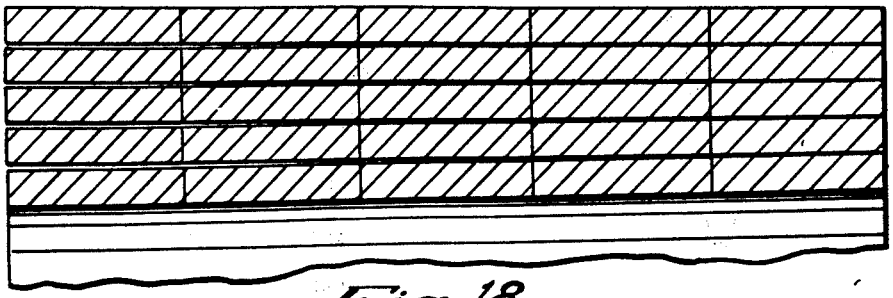
Fig. 18
Fig. 17a
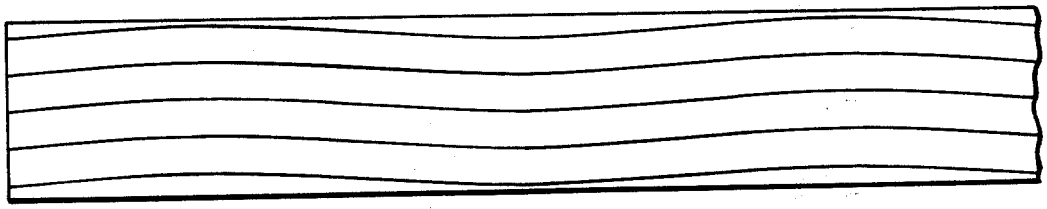
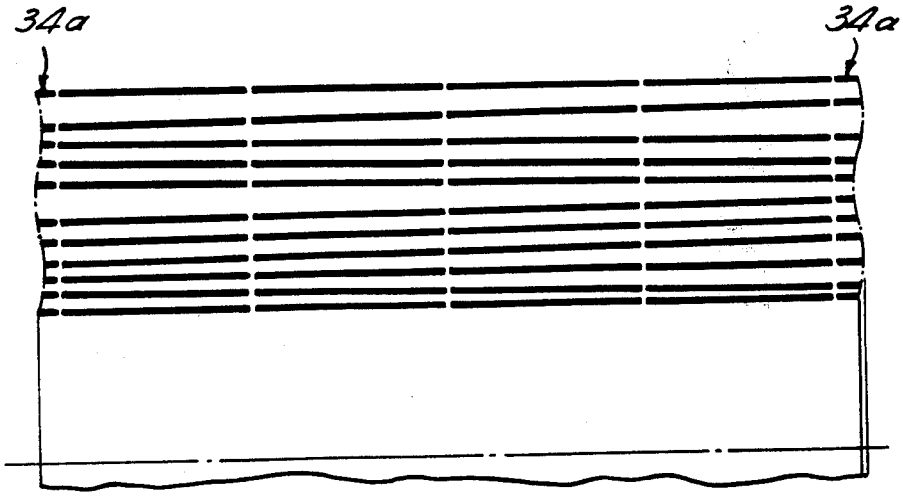
Fig. 18a

STEEL METAL WEB HANDLING METHOD

PRIOR APPLICATIONS

This application is a continuation of application Ser. No. 818,794, filed July 25, 1977, now abandoned, as a division of application Ser. No. 713,599, filed Aug. 12, 1976, which is a continuation-in-part of application Ser. No. 648,533, filed Jan. 12, 1976, now abandoned, the latter being a continuation-in-part of application Ser. No. 612,275, filed Sept. 11, 1975 now abandoned.

BACKGROUND OF THE INVENTION

In the manufacture of flat rolled metal it is most convenient and economical to form the web of a much greater width than is normally required by the end user and then slit the web into narrower strips of a suitable width. The metal web is coiled as it is processed, then, in a separate operation, placed on an uncoiler, unwound, trained through a slitter and then rewound as a number of separate narrower strips on the coiler. The slitting operation may be accomplished at the point of manufacture, by middlemen, such as warehousemen, or by the end user of the sheet metal.

Regardless of at what point the coil slitting takes place, inherent characteristics of the sheet metal and conventional coil slitting processes result in a number of difficulties to which the industry has responded in a manner which, in many cases, only solves the problems encountered by producing other, different problems.

For example, although the sheet of metal being slit is generally thought of as having a rectangular cross-sectional configuration, in fact, conventional sheet metal manufacturing processes produce a sheet which is crowned, i.e. is thicker, at its center than at its edges. Obviously, as such a sheet is rewound on a coiler as a series of separate strips following slitting, those strips slit from the center of the sheet are thicker and as a result are rewound more tightly than those strips slit from adjacent the edges of the sheet. This in turn results in so called "slack strands" being formed by the thinner strips between the slitter and coiler. To overcome the problem of slack strands a number of solutions have been advanced, and in fact are found in use today throughout most coil slitting operations.

One approach has been to insert pieces of cardboard or paper between the wraps of those coils positioned outwardly of the center coil to compensate for the differences in thickness of the strips being rewound. This is often performed manually, which is both cumbersome and dangerous, and even where performed mechanically is still cumbersome and requires a specially designed machine. In both cases, the cardboard or paper pieces must be removed later as the strip is decoiled for punching, pressing or other operations.

Two other, related approaches to the problem of slack strands are the looping and festooning of the strands intermediate the slitter and the coiler. Looping requires the provision of a deep pit, which is both inconvenient and expensive, while festooning requires the installation of a series of rolls mounted in towers above the process line, an obviously costly expedient, and in both looping and festooning control of the slack stands is always a problem.

While individual coilers could be provided for each of the strips resulting from the coil slitting operation, as a practical matter the expense of such provision will usually be prohibitive. Another approach which is based upon individual treatment of the slit strips but which does not require separate coilers is slip core winding. In this process, the strips are wound on nonmetallic cores that are allowed through friction to wind at a speed commensurate with the thickness of the strips. However, the cores used in this operation are in themselves expensive and must be retained within and shipped with the coils, and in addition they may distort under load and cause irregular winding.

Another problem characteristic of conventional coil slitting operations which is independent of the crowned configuration of the metal sheet and would, therefore, exist even if the sheet were perfectly rectangular in cross section, is interleaving of the strip edges as they are rewound on the coiler. Interleaving in turn results in damage to the edges of coil, loss of production time resulting from the necessity of manually separating interleaved coils and difficulties in feeding such coils, because of their damaged edges, through machinery such as punching presses and the like.

To prevent interleaving during rewinding, an attempt is generally made to keep the individual strips separate from each other. This may be accomplished by positioning spacer plates between coils or through the use of a series of discs which are mounted on a shaft separate from the coiler and allowed to penetrate between the coil edges as they are rewound.

Regardless of the particular manner in which separation is attained, it will be seen that separation requires lateral displacement of the individual strips from each other. This in turn requires that the coiler be spaced a considerable distance from the separator to allow the strips to fan out gradually from the slitter to the required spacing at the coiler. Ordinarily, to obtain a total lateral displacement of approximately two to three inches it is necessary to provide from fifteen to twenty feet of spacing between the slitter and the coiler.

From the above it will be apparent that conventional coil slitting operations possess many inherent disadvantages and present many problems which have traditionally either been accepted or only partially solved, often at the expense of introducing other difficulties and new problems into the process. A need therefore, has long existed for a new approach to coil slitting which obviates the problems of slack strands and coil interleaving and all of their attendant disadvantages.

SUMMARY OF THE INVENTION

In accordance with an invention disclosed in copending U.S. patent application Ser. No. 713,599, the description of which is incorporated herein by reference, coil slitting is accomplished in a two step operation which permits all of the strips slit from a single sheet to be rewound as a unit and thereby obviates the traditional coil slitting problems of slack strands and coil interleaving.

Although cutting web material is more than one cutting step is not unknown (see for example, U.S. Pat. No. 876,008), including cutting of metal strips in more than one step (U.S. Pat. Nos. 3,628,710 and 3,641,853), in such prior art cutting processes completion of cutting is accomplished before rewinding of the sheet being cut has commenced. As a result, the same problems of slack strands and interleaving that occur in conventional, one step cutting processes would occur in a two step process where the final cutting step is accomplished before rewinding has commenced, to the same extent that they would have occurred had the cutting been accomplished in only one step.

In contrast, in accordance with the aforementioned invention, as the unslit sheet is unwound from the uncoiler and trained through the slitter, the sheet is only partially slit or cut, or is fully slit and immediately lightly reconnected to provide the equivalent of partial slits or cuts, resulting in a set of interconnected strips which are delivered to the coiler as a single sheet. Thereafter, after rewinding has commenced, that is, at any time between the time when the interconnected strips have begun to wrap the coiler reel and such time as the coils are unwound for use, the partial cuts or equivalents made at the slitter may be completed to provide the separate, narrower coils desired. Since, until the partial cuts or equivalents made at the slitter are completed, the interconnected strips behave as a single sheet, they can be treated as such during coiling without fear of slack strands, strip interleaving and all of their attendant problems and difficulties.

In accordance with one aspect of that invention, complete separation of the coils is not made until the coils are ultimately unwound by the end user as, for example, they are fed into a press. In accordance with this aspect an additional advantage is gained over and above those discussed above in that individual banding and handling of separate coils following the slitting operation are eliminated. Or the coils may be individually broken off as units, preferably by the end user, rather than being individually unwound in which case individual handling may both (1) be more efficient than in conventional practice and (2) require little change from conventional practice in utilizing ordinary handling equipment such as cranes or lift trucks to transport and position individual slit coils.

Where final separation is performed by the end user, the elimination of individual banding and handling of separate coils is a major advantage of the invention. Instead, the original parent coil may be formed into a coil construct comprising an array of daughter coils which can be handled together until readily separated by the end user or the warehouser or other middleman. A particular advantage is the improved handling of scrap, and improved protection of coils is trans-shipment. Edge trim can be wound as disc-like coils at each end of the array of regular daughter coils rather than having to be balled, chopper or wound in the conventional manner. These disc-like coils then serve to protect the edges of the endmost regular daughter coils during shipment, and can be readily broken away at the site of coil use and, in some applications, even handled as a unit until remelted or reclaimed.

Final separation of this construct can be accomplished by individually unwinding one after another of the daughter coils which can be supported together on a single mandrel or unwinding stand to be successively (or even simultaneously) presented and fed to a working line or lines. Or, the daughter coils may be broken off as units prior to unwinding. This can optionally be done with breakaway grabs carried by cranes or lift trucks or by their own carriages or the like, so that the daughter coils can be handled by the end user in an efficient manner but in such a way as to be compatible with past procedure in handling individual coils.

From the above and from the following detailed description, it will be seen that the present invention provides an entirely new approach to coil slitting operations and eliminates many difficulties, disadvantages and problems associated with conventional processes by not attempting to combat these problems, but by simply obviating their source. Further advantages of the invention will appear from the following description.

BRIEF DESCRIPTION OF THE DRAWINGS

FIG. 4 is an enlarged cross-sectional view taken on the plane of line 4—4 of FIGS. 3 and 5;

FIG. 5 is a cross-sectional view taken on the plane of line 5—5 of FIG. 4;

FIG. 6 is a diagram of the momentary positions at the slitting nip of the edges seen in FIGS. 4 and 5 at different rotative positions of the slitting rolls;

FIG. 7 is a fragmentary view of the edge of a relieved cutter which the invention may employ;

FIG. 7*a* shows the edge of another relieved cutter which the invention may employ;

FIG. 17 is a schematic fragmentary foreshortened view of a slit strip or unwound daughter coil containing camber;

FIG. 17*a* is a foreshortened view on a smaller scale showing an elongated web of sheet material with serpentine or reversing camber;

FIG. 18 is a schematic fragmentary cross-sectional view, ignoring sheet crowning, of part of a coil array containing the strip of FIG. 17;

FIG. 18*a* is a very schematic cross-sectional view, ignoring sheet crowning, of part of a coil array containing the web of FIG. 17*a*.

DESCRIPTION OF THE ILLUSTRATED EMBODIMENTS

Figures 1, 2, 3:
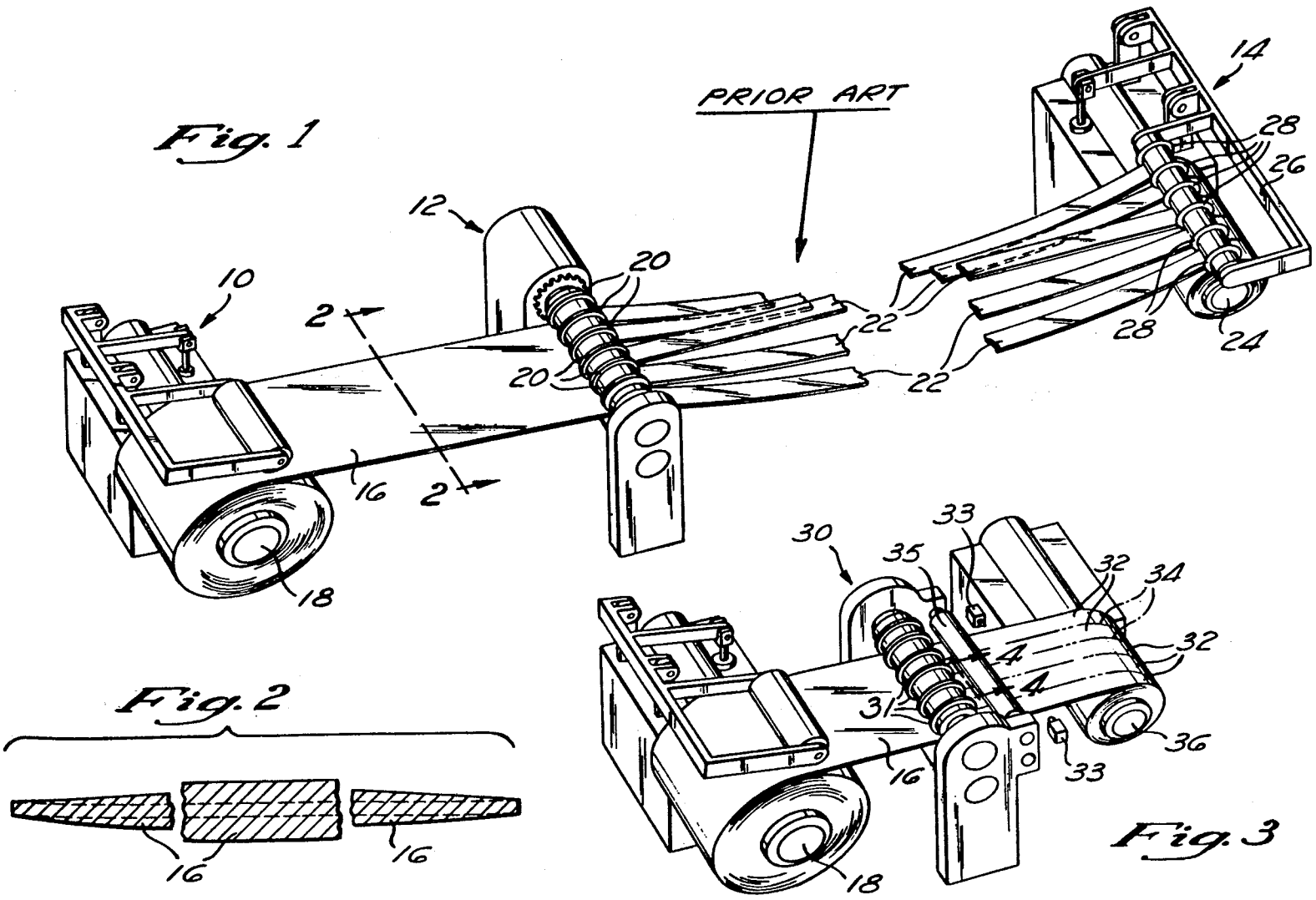
PRIOR ART Fig. 1
FIG. 1 is a perspective view of a prior art slitting line.
FIG. 2 is a cross-sectional view on line 2—2 of FIG. 1.
FIG. 3 is a perspective view showing a slitting line in accordance with the present invention.

For purposes of background, FIG. 1 of the drawings discloses, somewhat schematically, a more or less conventional slitting line including an un-coiling station 10, a slitting station 12, and a coiling station 14. In accordance with accepted practice, a coil of sheet metal or the like 16 is placed upon an unwind mandrel 18 and trained through the slitting station 12.

At the slitting station upper rotary cutters, as at 20, cooperate with like cutters, not shown, disposed beneath the strip and offset with respect to the cutters 20 to slit the incoming strip into a series of narrower strips 22. The strips 22 are then rewound on a rewind mandrel 24 and a separating device 26 including separating discs 28 serves to prevent interleaving or overhang of the edges of the rewound strips 22.

It will be noted from FIG. 1, that in order to provide the necessary separation at the coiling station 14, the slitting and coiling stations must be positioned a substantial distance from each other.

Additionally and with reference to FIG. 2 of the drawings, it will be noted that the cross-sectional configuration of the sheet 16 varies considerably from an ideal rectangular configuration, shown in dashed lines in FIG. 2, with the center of the sheet actually much thicker than the edges thereof. As a result, strips cut from the center of the sheet are thicker than those cut from areas displaced outwardly from the center and the center strips are, therefore wrapped more tightly than the outside strips.

This results, as seen in FIG. 1 of the drawings, in the outer strips sagging between the slitter and the coiler. Although only a relatively small amount of sag is shown in the drawings, it will be apparent that as the slitting and coiling process proceeds, the resulting sag will be substantial, requiring pits formed between the slitter and coiler or a system of rollers for festooning the outer strips above the slitting line.

All of the above problems are obviated with the invention of U.S. patent application Ser. No. 713,599 and with the present invention by maintaining limited connection between the slit strips at the slitting station and completing their separation after the sheet has commenced coiling on the rewind mandrel. Thus, as seen in FIG. 3 of the drawings, as sheet 16 is unwound from the mandrel 18 and trained through a slitting station 30, the sheet is predivided into strips 32 while maintaining limited connection, as indicated by the dash-dot lines 34. Therefore, as the interconnected strips 32 are rewound upon the mandrel 36 they, in effect, behave as a single sheet.

As a result, there is no necessity of maintaining separation between the edges of adjacent strips, nor do the inner strips sag between the slitter and the coiler. As will be particularly apparent from FIG. 3 of the drawings, because the necessity for lateral displacement of the strips at the coiler is eliminated the coiler may be positioned adjacent the slitter, providing a much more compact slitting line and, as will be discussed in detail below, rendering possible the use of a single piece of equipment for both partial slitting and final separation.

Compactness of the slitting line is however only one benefit of the relative adjacency between slitter and coiler. More significant is the achievement of constraints on the strips during coiling to cause them to wind with almost perfect tracking into daughter coils separated by flat side faces. It has been discovered that momentary constraints imposed by the slitting cutters on the side edges of the slit strips can be "extended," so to speak, by causing the slit strips to behave as a single sheet (by tying the edges of adjacent strips together, during or immediately following slitting, as herein described), and that such constraints can be "captured," so to speak, to be made part of the coiling operation by taking up the slit strips on a coiler before such constraints have dissipated with continuing travel of the strips away from the slitting cutters. The result is daughter coils separated by flat interfaces through which extend the breakable ties disposed for clean breakaway shearing action. The constraints can accomplish such flat interfaces despite the almost inevitable occurrence of camber in the sheet material being slit and despite the resultant camber in the slit strips, and even despite a slight degree of yaw in the feed roll supplying the sheet material to the slitter.

The close coupling between the slitter and coils contemplated by important aspects of the invention can be eliminated, but only at a cost in reduction of tracking accuracy that will often be unacceptable or at least pointless.

Partial pre-slitting, or the equivalent, can be accomplished periodically or non-periodically, and intermittenly or non-intermittently. An example of periodic non-intermittent pre-slitting is the use of flats on slitting cutters to periodically produce tacks (upon every revolution of the cutters) without skipping tacks during some revolutions. An example of periodic intermittent pre-slitting is a similar arrangement in which the slitting cutters are positioned so that tacking does not occur, but in which such slitting cutters are intermittently shifted to cause periodic tacking to occur. An example of non-periodic non-intermittent pre-slitting is the provision of slitting cutters which continually completely slit followed by immediate partial reconnection by the continuous or non-periodic action of rollers positioned just beyond the slitting cutters, without any interruption of such action of the rollers that accomplish reconnecting. An example of non-periodic intermittent pre-slitting is a similar arrangement in which the rollers that accomplish reconnecting are positioned so that such reconnecting does not occur, but in which such rollers are intermittently shifted to cause such reconnection to occur.

As noted above, pre-division can be accomplished in accordance with the present invention in a number of different ways. For example, the strip can be provided with alternating fully separated and less than fully separated sections. Separated sections of say, a few feet in length, or a few inches in length in the case of thinner material, are joined by less than fully separated sections of relatively short length. Alternatively, the strip can be continuously separated and then rejoined, as mentioned above. In some applications it may be possible that the opposed cutters 31 (FIG. 3) can be provided without flats or reliefs and adjusted to provide a continuous shear line between adjacent strips 32 with the strip sheared to a point just short of complete fracturing and the fracture completed after rewinding has commenced.

The alternative separated and unseparated areas may be produced in a number of ways, including mounting one or both of the cutters somewhat eccentrically, providing one or both of the cutters with flats or other relief shapes on their peripheries or on the faces near their cutting edges, providing a cam action or the like for adjustment of one or both of the cutters relative to each other in direction perpendicular to the face of the sheet 16. The reliefs on each cutter may be each insufficient to prevent full separation alone, but capable of doing so if in registration with the relief on the associated cutter, and the reliefs may be brought into and out of register by advancing or retarding the angular position of one cutter relative to the other, by means of a differential drive or the like, as they both continue to rotate through the cutter nip. Combinations of these arrangements may be provided.

All of the above arrangements for providing partial pre-slitting, or the equivalent thereof, can be referred to as "tacking" arrangements. The slit strips are caused to continue to move together by being tacked together, periodically or non-periodically, and intermittently or non-intermittently.

Both periodic and non-periodic or continuous tacking involve maintaining connection between the slit strip edges sufficient to cause the slit strips to wind together. Such maintaining of connection may itself be non-intermittent or it may be made intermittent by interruptions either on a pre-programmed or on a demand basis.

As an example of a demand control, as seen in FIG. 3, sensor means 33 may be provided between the slitting station 30 and winding mandrel 36 for sensing sagging or tension difference or other differences or incipient difference in winding of the slit strips. The sensor may be any appropriate device such as a tension sensor or, as shown, a photoelectric sensor.

Cutter 31 and its companion are positioned close enough for continuous slitting until such time as the sensor 33 detects differences or incipient difference in the winding of the strips 32 whereupon the cutters are moved apart or otherwise adjusted by automatic means (not shown) sufficiently to commence maintaining periodic tacking between the edges of the strips 32 sufficient to cause them to wind together. This condition may be terminated after a given time, in terms of distance or time units, or may be terminated after winding differences or incipient differences are no longer detected.

FIGS. 4 and 5 illustrate the configuration that may result in the region of a "tack" or periodic partially separated area. The adjacent strips 32 are displaced vertically with respect to each other when they engage the cutters, and spring back together when they are fully separated. However in an area of partial separation, the adjacent strips continue to be joined by a bridge 48 of the parent metal connecting the metal of the adjacent coils and maintaining the vertical displacement of the adjacent strips 32 with respect to each other, as seen in FIG. 5, thereby maintaining an increased overall thickness of the adjacent strips (considered together as a unit) and thereby an increased overall thickness at the locations of the bridges in the turns of the array of daughter coils formed upon coiling.

FIG. 6 diagrams the momentary positions at the cutter nip of the edges, a, b, c, d seen in FIG. 4 plotted against different rotative positions of the cutters. The rotative positions of the cutters corresponding to passage through the nip of the flats on the cutters are between positions e and f. The vertical locations g and h on the diagram represent the height of the top and bottom surfaces of the metal sheet prior to close approach to the cutter, and of the fully slit portions following passage through the cutter.

Even if only one cutter is relieved, the cutting action will be similar to that illustrated in FIG. 6. Although the corresponding curves would not be exactly symmetrical about a horizontal axis, they would be roughly similar to the illustrated curves because the adjacent not-yet-parted strips 32 tend to center themselves vertically between cutters even if only one cutter is relieved.

FIG. 7 illustrate the relief of a single cutter 61 designed to operate with a corresponding unrelieved cutter (not shown). The circular periphery at 62 is relieved by a flat 63 which is faired into the periphery of the cutter at ends 64 and 65.

Figure 8:
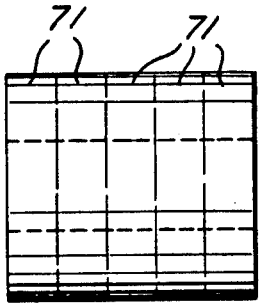
FIG. 8 is a side elevation of an array of daughter coils.
Figure 9:
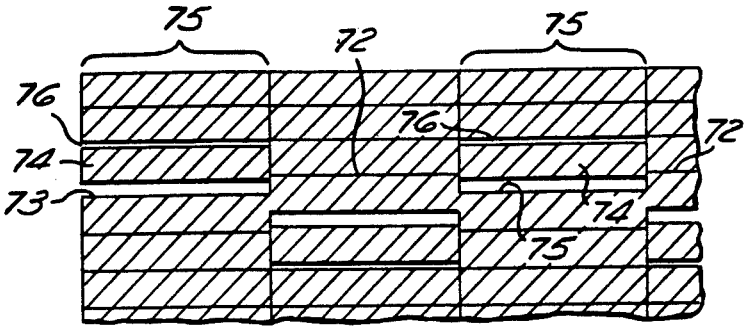
FIG. 9 is a schematic fragmentary cross-sectional view, ignoring sheet crowning, of the upper left edge of the coil array seen in FIG. 8, taken on the plane of the paper.

When the metal is coiled after passing through the cutters, a plurality of daughter coils 71 are formed, as seen in FIG. 8. The transverse profiles of the turns of the array comprise raised portions 72 and notched portions 73, as seen in FIG. 9.

The notched portions such as 73 may be slightly downwardly penetrated by a succeeding wrap of the corresponding daughter coil. Thus in FIG. 9 each notch 73 is slightly penetrated by the first succeeding wrap 74 of its corresponding daughter coil 75. (Similarly the second succeeding wrap may penetrate the slight gap 76 left by wrap 74, and so forth in respect of still later wraps, but the occurence of such penetrations beyond the first succeeding wrap is not illustrated.) Corresponding upward penetration may also occur with respect to the reliefs under the raised portions 72, as shown, although any such upward penetration will tend to be minimized by the effect of winding tension.

Figure 10:
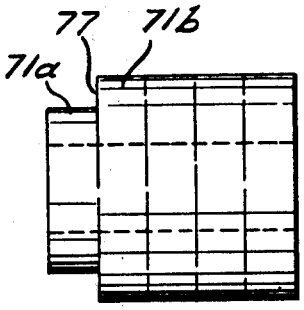
FIG. 10 is a view similar to FIG. 8 with one of the daughter coil partially removed.

The edges of the daughter coils are thereby kept in alignment to prevent edge overhang in circumstances where edge overhang night otherwise occur due to the particular circumstances of coiling. Thus as a daughter coil 71*a* is uncoiled as in FIG. 10, there is no interference with the face 77 comprising the edges of the turns of the adjacent daughter coil 71*b*.

Figure 11:
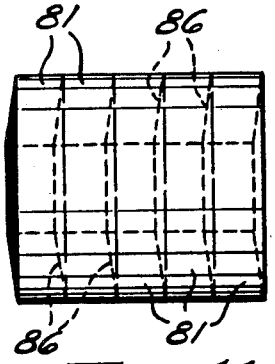
FIG. 11 is a side elevation of another array of daughter coils.
Figure 12:
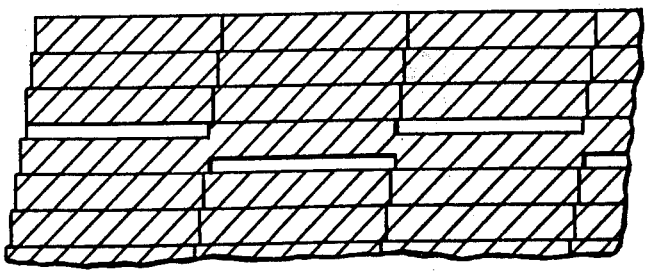
FIG. 12 is a schematic fragmentary cross-sectional view, ignoring sheet crowning, of the upper left edge of the coil array seen in FIG. 10, taken on the plane of the paper.

The array of daughter coils may be formed in a dished configuration as seen in FIG. 11. This may be done by shifting the coiler axially in one direction throughout the coiling operation. Each of the daughter coils 81 and each of the interfaces 86 between daughter coils is dished. The edges of adjacent daughter coils are thereby stepped in a uniform direction, as seen in FIG. 12, whereby edge overhang is avoided and no edge interference occurs when the daughter coils are individually uncoiled.

The arrays of daughter coils are removed from the rewind mandrel and shipped to the end user or the warehouseman or other middleman still interconnected. Final separation takes place as the strips are needed, using any of the final separating processes mentioned herein.

Figure 13:
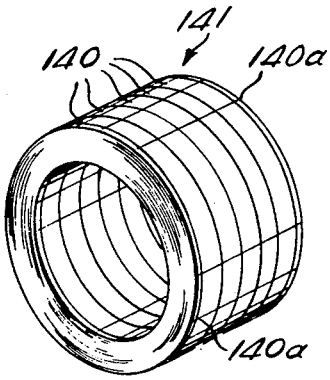
FIG. 13 is a perspective view of a coil construct contemplated by the invention.
Figure 14:
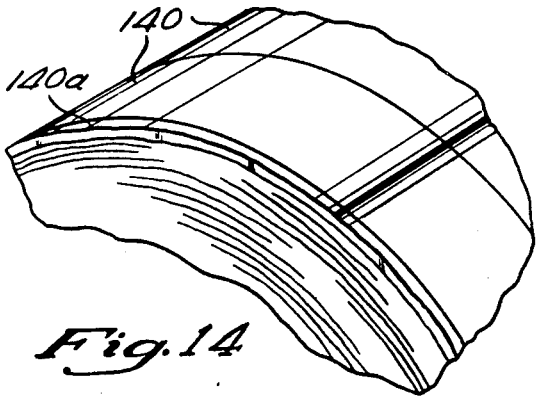
FIG. 14 is a fragmentary detail of FIG. 13.

One particular arrangement for final cutting is shown in FIG. 13. Here a daughter coil 88 is being unwound from its parent coil 89, the unwrap reach being indicated by reference member 90. In this case, to aid separation of the daughter coil, a prizing blade 91 is provided as most clearly illustrated in FIGS. 13*a* and 13*b*. This blade is bolted to and held by a wedge finger 92 over which the unwrap reach 90 slides and under which the wound turns of the daughter coil 88 pass. The unwrap reach 90 slides on top face 93 of finger 92. Finger 92 is supported on a flange 97 by a pivot bolt 94 provided with a spring 95 adapted to yieldingly center finger 92 in the illustrated horizontal position. Flange 97 projects from crosshead 98 which slides vertically on four columns (two of which are shown) protruding from a pair of spaced pedestal supports (one of which is shown). Raising and lowering is done by actuating cylinder 96. The underside of finger 92 can ride directly on the still wrapped portion of daughter coil 88.

The leading edge of prizing blade 91 may, as illustrated, depend slightly below top face 93 of finger 92, so that the blade projects partly into the shear line associated with the next succeeding wrap of the daughter coil to pre-initiate separation at the turn that precedes actual unwrapping or at least to aid in maintaining the position of the prizing blade 91 immediately next to the edge of the adjacent layer of still wrapped coil that corresponds to the then-unrapping layer of the daughter coil. In some cases such pre-initiation or position-maintaining aid is unnecessary and the depending portion of blade 91 can be omitted.

The prizing blade 91 acts to laterally wedge or prize the top turn of the daughter coil that is being unwrapped away from the corresponding layer of adjacent still-wrapped coil to a sufficient extent to break the remaining connection between the two. As intimated in the foregoing description, the action may be one more of wedging or prizing than of cutting.

It will be appreciated that various combinations of partial slitting techniques and separating techniques may be utilized in accordance with the present invention. For example, after partial slitting is accomplished by any of the various methods discussed above, the cut may be completed at any time after rewinding has commenced.

Figure 16:
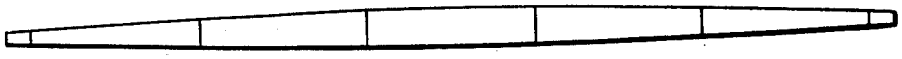
FIGS. 15 and 16 are schematic cross-sectional views taken across the straight reach of slit strip at different points prior to the wrapping thereof to form the coil construct.
Figure 15:
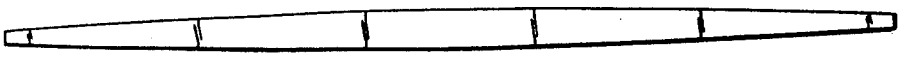
Figure 16A:
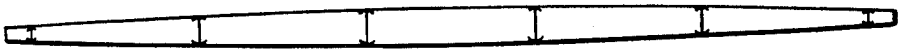
FIG. 16*a* is a schematic cross-sectional view taken across the straight reach of slit strip prior to the wrapping thereof, but when the machine is set up somewhat differently than when it produces strip having the cross-sections schematically illustrated in FIGS. 16 and 15.

FIGS. 15 and 16 are schematic cross-sections of the slit strips immediately downstream of the knock-down rolls 35 in FIG. 3. FIG. 15 shows a region of tacking, the bridges between the adjacent strips being shown as more or less sheared but not completely parted. FIG. 16 shows a fully slit region.

Because of the crown seen in FIGS. 15 and 16, the edgeward daughter coils forming the parent coil 141 are wrapped more loosely than the more central daughter coils. However because the daughter coils are constrained to wrap together they all have the same number of turns per unit length. The "tacks" are such that the connections between adajacent daughter coils are contained entirely between the front and back faces or surfaces of the sheet metal. The front or back faces are not uninterrupted across the "tacks," as would be the case if slitting were entirely discontinued at the connecting regions. The opposite edge faces of adjacent daughter coils created by the slitting operation each have a continuous corner edge throughout the length of the daughter coils, including the "tacked" portions thereof.

As previously indicated, the constraints on the strips during coiling that can be accomplished by the invention provide flat interfaces between daughter coils despite almost inevitable cambering of the sheet material and the slit strips forced therefrom. The camber is accommodated by variations in tightness of wrap as schematically illustrated in FIG. 18. FIG. 17 shows on a reduced scale one of the strips resulting from uncoiling one of the daughter coils of FIG. 18, with camber clearly present. Nevertheless, the interfaces between daughter coils are substantially planar as seen in FIG. 18. Thus, although in a general sense "tacking" according to the invention causes all daughter coils to wind together at the same uniform lengths per unit turn despite variation in their thicknesses, there are specific slight variations from one daughter coil to the other of turns per unit length, such variations being a function of the degree of camber being encountered. More precisely, there are very slight differences in tightness of wrap of the opposite side edges of each daughter coil, beyond that incident to sheet crowing, just sufficient to accommodate the camber in each coil. It appears that the invention can force these slight variations in turns per unit length and these slight differences in tightness of wrap of opposite side edges of each daughter coil to occur to just the extent necessary to accomplish the substantially planar interfaces between daughter coils.

FIGS. 17*a* and 18*a* illustrate, even more schematically, the situation when the camber is serpentine or reversing, as may be caused for example by slight variations in the feed to the slitting cutters. In FIG. 18*a* the interfaces between adjacent pairs of daughter coils are flat despite the camber, and the two side edges of each daughter coil and of the parent coil incrementally along their lengths differ from each in tightness of wrap, beyond the differences incident to crowning of the sheet from which the coils are formed, as a function of the degree and direction of camber of the strip material incrementally along its length. FIG. 17*a* shows on a reduced scale the development of the coil shown in FIG. 18*a* illustrating the serpentine or reversing nature of the camber. In such a situation the outside ends of the parent coil may be very uneven, as seen in FIG. 18*a* yet the interfaces between adjacent daughter coils are flat, as shown.

FIG. 18*a* also illustrates parts of the disc-like coils of scrap, indicated at 34*a*, that can be used to protect the edges of the parent coil in trans-shipment, as previously mentioned, and that can be broken off or unwound from the parent coil either prior to trans-shipment or by the finel user. Such discs of scrap are not specifically illustrated in FIG. 3 due to the small scale thereof.

The outer ends of the parent and daughter coils may be secured against unwinding by being taped down to the next turn of material. For trans-shipment it may be desirable to band the parent coil through the coil core say with three bands spread 120 degrees apart. The disc-like coils 34*a* of scrap or edge trim protect against the bite of the banding.

Although the outside edges of the edge trim coils may be quite irregular, as shown, the internal interfaces are flat, as also shown in FIG. 28*a*.

Figure 19:
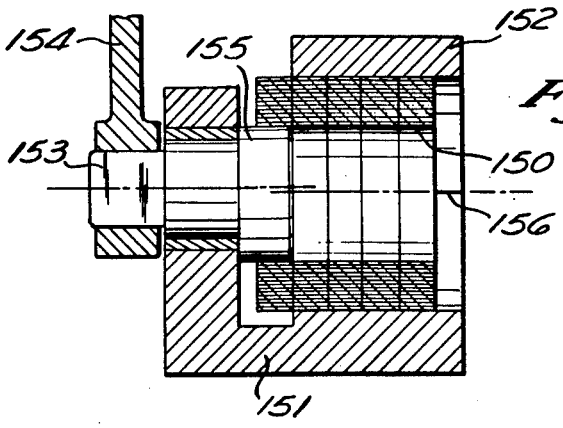
FIG. 19 is a schematic cross-sectional view of one form of coil breakaway device contemplated by the invention.

A breakaway device for simultaneously breaking away all the connections of a daughter coil is schematically illustrated in FIG. 19. A parent coil is clamped on a frame 151 by a clamping member 152 releasably fixed to the frame at parting line 156 by clamping bolts or other clamping fasteners (not shown). The endmost daughter coil is received on a mandrel 155 which is initially aligned with the open core 150 of the parent coil. The mandrel 155 is eccentrially mounted in the frame 151 and has a squared end 153 which receives a wrench 154. Turning the wrench turns the mandrel 155 in its eccentric mounting and twists the endmost daughter coil relative to the adjacent daughter coil, causing the endmost daughter coil to break away. The break is clean and the points of former connection between the coils are barely discernable, if at all. To break off a succeeding daughter coil, the clamp is loosened and the parent coil is advanced to the left by the width of one daughter coil and reclamped.

Figure 21:
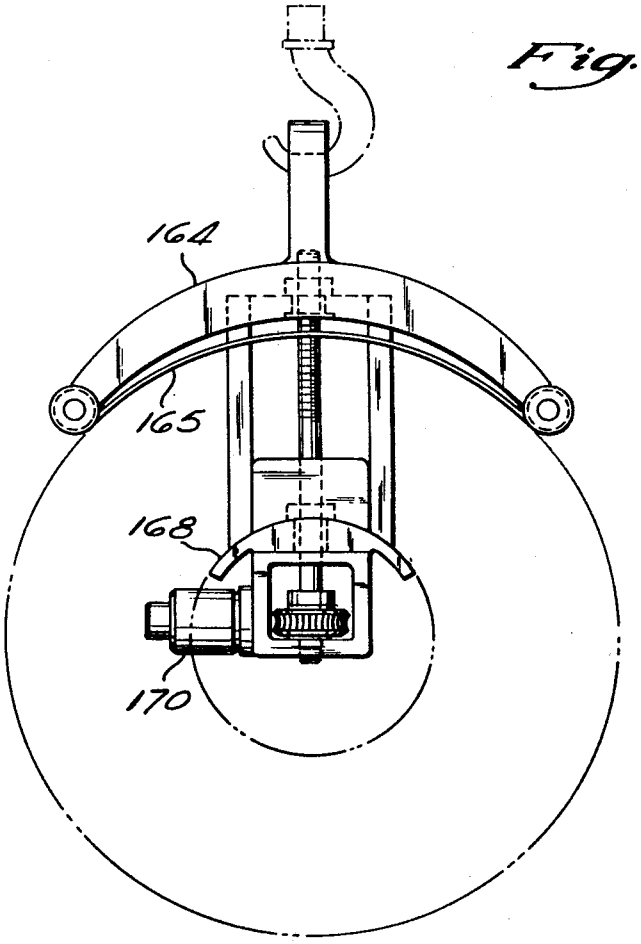
FIG. 21 is an end elevation of the device seen in FIG. 20.
Figure 20:
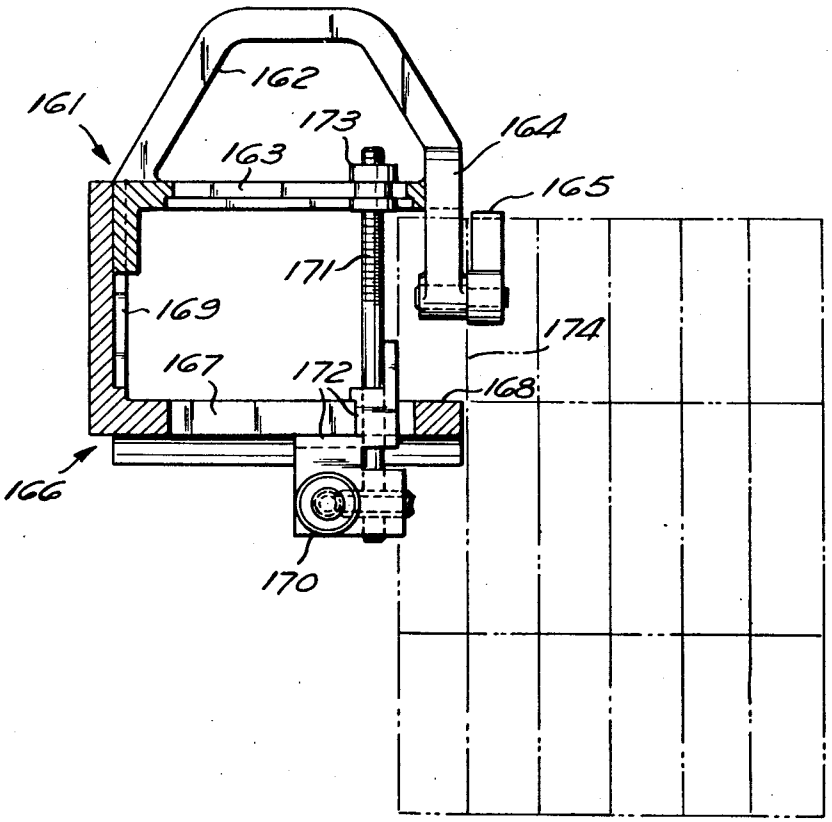
FIG. 20 is a side elevation, partly in cross-section, of another breakaway device in the form of a coil breakaway grab.

A breakaway grab device such as illustrated in FIGS. 20 and 21 can be utilized by the end user of the pre-slit parent coil in a manner that can be more efficient than conventional practice and require little change from conventional practice in utilizing ordinary handling equipment such as cranes or lift trucks to transport and position individual coils broken away from the parent coil. The illustrated grab includes an upper frame 161 which includes a suspension eye 162, a slideway 163 and a yoke 164. An upper gripping strap 165 of somewhat flexible material such as a flexible steel strap is pivoted on small stubs carried at each end of the yoke 164 in the manner shown.

A lower frame 166 includes a slideway 167 and an arcuate lower gripper 168. The upper and lower frames slide with respect to each other along a slideway 169. A clamping linkage including the motor 170 and screw 171 is associated with a clamp drive frame 172 received in the slideway 169 and a screw nut 173 received in the slideway 163.

The device may be suspended from a crane in the manner shown. To break away a daughter coil the member 168 is slipped into the coil and under the endmost daughter coil with the strap member 165 positioned just beyond the endmost daughter coil and over the next daughter coil, so that the members 165 and 168 engage the coil on opposite sides of the plane of the interface 174. The motor 170 is then actuated to close the clamp whereby the endmost daughter coil breaks away but rests on the member 168 with the outer side face of its upper half perhaps lightly engaged or at least retained by slight interference with one side of the strap member 165. The separated daughter coil can then be transported to its particular place of use by the crane and can be released by actuating the motor 170 to open the clamp to the point where the strap 165 no longer interferes with the outer side face of the daughter coil.

The slideways 163 and 167 allow the clamping linkage to be adjusted laterally for accommodation of daughter coils of different widths, since it is generally desirable to position the linkage as close as possible to the endmost daughter coil prior to breakaway.

Instead of or in addition to the eye 162, mounting brackets (not shown) can be provided to fix the frame member 161 or 166 to the lifting member of a lift truck. Or any special carriage or the like (not shown) may be provided for the grab.

Figure 22:
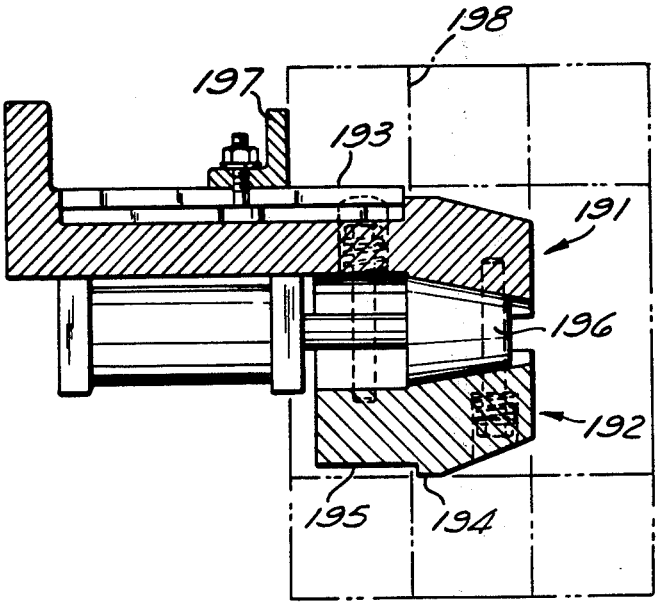
FIGS. 22 and 23 are side and end elevations of another breakaway grab.
Figure 23:
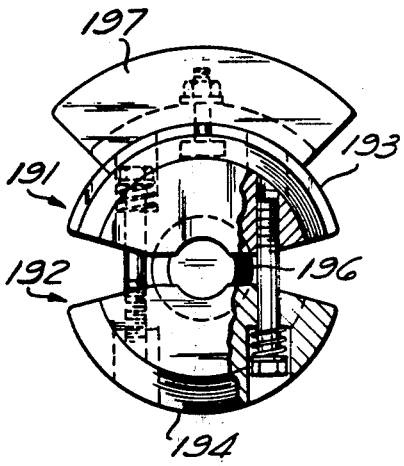

Another form of grab is shown in FIG. 22 and 23. A pair of clamping members 191 and 192 are shaped to penetrate the core of a parent coil and engage different segments thereof. Member 191 engages the coil at arcuate face 193 and member 192 engages the coil at arcuate face 194. Members 191 and 192 may be tapered forwardly as shown to aid in guiding the insertion of the grab. The members are urged apart by the illustrated hydraulically powered frustro-conical wedging member 196 against the biasing of springs associated with draw rods or bolts which guide members 191 and 192 in their relative motion in the manner illustrated.

A stop member 197 defines the depth of penetration of the grab, and its position may be adjusted along a marked scale (not shown) by loosening and retightening a tie-bolt in a T-slot, as illustrated, to thereby set the depth of penetration of the grab according to the thickness of the daughter coils.

Surfaces 193 and 194 terminate in slightly spaced relationship from each other so that they may be spaced slightly to each side of the interface 198 between the adjacent segments they are grabbing, as shown in FIG. 34. This reduces the criticality of the magnitude of the depth of penetration of the members 191 and 192.

Means (not shown) is provided to fix the back end of the member 191 to the lifting member of a lift truck, or to suspend it from a crane or mount it on a special carriage for the grab.

When the endmost daughter coil is broken off by expansion of the members 191 and 192, this coil remains supported on the surface 193. At this point the grab may be slightly contracted and backed out of the core far enough to clear member 192 from the daughter coil which it engaged. The members 191 and 192 may be then expanded again, to a further degree, until the relief surface 195 engages the core of the broken off daughter coil. The coil is now securely grasped and may be tilted in handling, if desired.

It may be noted that when a daughter coil is unwound from the parent coil, rather than being broken away as just described, the unwinding may be arranged to give a spreading action whereby the path of movement of the separating strip has a vector component parallel to the roll axis. (One example of such an arrangement is shown in FIG. 13 and involves use of the prizing blade 91.) Movement along such vector cannot be accommodated by flexing of the strip material around the axis of the roll but rather is stiffly resisted by reaction forces acting parallel to the axis and to the surface of the strip material. Unwinding arrangements involving a separating movement with such a vector component therefore can be very effective in subjecting the tacks to concentrated tensile stresses for good breaking action. In some instances this can be accomplished by gravity alone, as when a starting end of an endmost daughter coil is dropped from the lower end of a parent coil which is tilted toward a vertical position so that the starting end continues to unwind by its own weight. I have unwound hand-held experimental coils in this manner, allowing the endmost daughter coil to rapidly unwind in a falling helix and accumulate as loose strip on the floor, with the remainder of the parent coil remaining intact and the exposed side of the next-to-endmost daughter coil remaining a smooth and well-defined surface.

While the methods and forms of apparatus and constructs herein described constitute preferred embodiments of the invention, it is to be understood that the invention is not limited to these precise methods and forms of apparatus and constructs, and that changes may be made therein without departing from the scope of the invention.

What is claimed is:

1. A method of handling an elongated web of sheet metal including dividing the metal into a plurality of strips including edge trim strips, winding all the strips into a plurality of daughter coils, and maintaining edges of adjacent strips connected together during the winding to a degree sufficient to constrain the daughter coils to form a parent coil consisting of a plurality of immediately adjacent daughter coils the outermost of which at one or both ends of the parent coils is an edge trim strip, transporting said parent coil with said edge trim strip in place for edge protection, and subsequently separating said edge trim strip associated with at least one end of the parent coil prior to or incident to separation of one or more of the other daughter coils.

2. A method as in claim 1, said step of separating said edge trim strp being accomplished by breaking said edge trim strip as a coiled unit away from the immediately adjacent daughter coil.

3. A method as in claim 2, including the step of maintaining the separated edge trim strip as a coiled unit during at least some subsequent handling incident to remelting or other reclaiming.

4. A method of handling an elongated web of sheet metal including dividing the metal into a plurality of strips, winding the strips into a plurality of daughter coils capable of being broken or unwound from each other, such winding of the daughter coils being at varying degrees of tightness of wrap, and maintaining edges of adjacent strips connected together during the winding to a degree sufficient to constrain the daughter coils to form a parent coil consisting of a plurality of immediately adjacent daughter coils, transporting said parent coil in one or more stages to its general area of use, applying breakaway-grab means carried by lifting means, to said parent coil to break away one daughter coil at a time and carry said daughter coil to a particular place of use.

5. A method of handling an elongated strip of sheet metal slit from an elongated web of sheet metal comprising forming from the sheet metal a parent coil that is preslit into a plurality of daughter coils attached to but breakable from each other and one of which is the elongated strip first recited, then transporting the parent coil to thereby transport as part thereof the elongated strip first recited, then applying breakaway grab means carried by lifting means to said parent coil to break away one daughter coil at a time, including in its turn said elongated strip first recited, and carrying said daughter coil, including in its turn said elongated strip first recited, to its particular place of use.

6. A method for disposing of edge-scrap slit from an elongated web of sheet metal comprising dividing the edge-scrap from the elongated web, winding the elongated web while maintaining the divided edge-scrap breakably connected thereto to a degree sufficient to cause the edge-scrap to wind therewith and form discs at the sides thereof, and thereafter breaking off the edge-scrap from the elongated web.

7. A method as in claim 6 in which said step of breaking off comprises breaking away each of such discs as a unit.

8. A method of handling an elongated web of sheet metal including dividing the metal into a plurality of strips, winding the strips into a plurality of daughter coils capable of being broken or unwound from each other, such winding of daugther coils being at varying degrees of tightness of wrap, and maintaining edges of adjacent strips connected together during the winding to a degree sufficient to constrain the daugther coils to form a parent coil consisting of a plurality of immediately adjacent daughter coils, transporting said parent coil in one or more stages to a first site, applying means for separating said daughter coils from said parent coil, and transporting said separated coils to a second site.

9. A method of handling an elongated strip of sheet metal slit from an elongated web of sheet metal comprising forming from the sheet metal a parent coil that is preset into a plurality of daughter coils attached to, but breakable from each other and one of which is the elongated strip first recited, then transporting the parent coil to thereby transport as part thereof the elongated strip first recited, selectively severing daughter coils from said parent coil, including in its turn said elongated strip first recited, and carrying the severed daughter coils, including in its turn said elongated strip first recited to its particular place of use.

* * * * *

UNITED STATES PATENT AND TRADEMARK OFFICE

CERTIFICATE OF CORRECTION

PATENT NO. : 4,171,080

DATED : October 16, 1979

INVENTOR(S) : John W. Rogers

It is certified that error appears in the above-identified patent and that said Letters Patent are hereby corrected as shown below:

Column 2, line 58, change "is" to -- in --.

Column 3, line 47, change "chopper" to -- chopped --.

Column 9, line 61, change "forced" to -- formed --.

Column 10, line 9, change "crowing" to -- crowning --.

Column 13, line 4, change "stp" to -- strip --.

Signed and Sealed this

*Nineteenth* Day of *February 1980*

[SEAL]

*Attest:*

SIDNEY A. DIAMOND

*Attesting Officer*

*Commissioner of Patents and Trademarks*